US005703837A

United States Patent [19]

Umemoto et al.

[11] Patent Number: 5,703,837

[45] Date of Patent: Dec. 30, 1997

[54] WATCH WITH LIGHT TRANSMITTING TYPE DISPLAY PLATE

[75] Inventors: Toshio Umemoto; Masami Fukuda; Kenji Shimoda; Yasuo Kitajima; Isamu Kobayashi; Yurie Udou, all of Tanashi, Japan

[73] Assignee: Citizen Watch Co., Ltd., Tokyo, Japan

[21] Appl. No.: 549,702

[22] PCT Filed: Feb. 10, 1995

[86] PCT No.: PCT/JP95/00188

§ 371 Date: Nov. 15, 1995

§ 102(e) Date: Nov. 15, 1995

[87] PCT Pub. No.: WO95/27234

PCT Pub. Date: Oct. 12, 1995

[30] Foreign Application Priority Data

| | | | |
|---|---|---|---|
| Mar. 31, 1994 | [JP] | Japan | 6-63450 |
| Apr. 8, 1994 | [JP] | Japan | 6-70299 |
| May 23, 1994 | [JP] | Japan | 6-108372 |

[51] Int. Cl.[6] ..... G04B 19/30; G04B 19/06

[52] U.S. Cl. ..... 368/88; 368/227; 368/232

[58] Field of Search ..... 368/67, 88, 205, 368/223, 226–228, 233, 234, 239; 362/23, 26, 27, 29, 34, 62, 84

[56] References Cited

U.S. PATENT DOCUMENTS

| | | | |
|---|---|---|---|
| 4,775,964 | 10/1988 | Alessio et al. | 368/67 |
| 5,265,071 | 11/1993 | Thorgersen et al. | 368/67 |
| 5,426,621 | 6/1995 | Akasaka | 368/226 |

FOREIGN PATENT DOCUMENTS

| | | |
|---|---|---|
| 52-89148 | 7/1977 | Japan . |
| 56-33580 | 4/1981 | Japan . |
| 61-132787 | 8/1986 | Japan . |
| 63-5024 | 2/1988 | Japan . |
| 63-78294 | 5/1988 | Japan . |
| 3-191329 | 8/1991 | Japan . |

*Primary Examiner*—Vit W. Miska
*Attorney, Agent, or Firm*—Kanesaka & Takeuchi

[57] ABSTRACT

A light transmitting type display plate 5 is arranged above a cell 2 such as an EL element or a solar cell or the like, and the display plate 5 is fixed to the support member 4 through the engagement of a positioning section **5*b* formed on the light transmitting type display plate 5 with a positioning section 4*b* formed on a support member 4. In the case where the light transmitting type display plate is a transparent plate 5, a spacer 6 or the like forms a gap 7 between the cell 2 and the transparent plate 5**.

21 Claims, 16 Drawing Sheets

WATCH WITH LIGHT TRANSMITTING TYPE DISPLAY PLATE

FIELD OF THE INVENTION

The present invention relates to a watch provided with an EL (electroluminescence) element, a solar panel, or the like and a light transmitting type display plate.

DESCRIPTION OF THE PRIOR ART

In recent years, watches which utilize an EL element or a light emitting diode (LED) or the like have been developed. When a symbol or a hand which indicates the time is illuminated by light emitted from a built-in lamp, LED, or an EL element, it becomes possible to tell the time even in the dark.

A conventional structure with a display plate and a light diffusion plate used together with an EL element or a lamp or a light emitting diode, fixed to the movement, is disclosed, for example, in Japanese Laid Open Patent Application (kokai) No. 84886/1993. The fixing structure has a transparent display plate and a light diffusing plate having almost the same shape as the transparent display plate and positioned on the bottom surface of the transparent display plate, the both being fixed to a support frame using double-sided adhesive tape.

This type of conventional fixing structure has a superior feature inasmuch as it is possible to easily fix the light diffusing plate and the transparent display plate to the support frame. However, the structure has a disadvantage in that the positioning is unstable because it is not possible to position the transparent display plate and the support frame. Therefore, the positioning depends, in the final analysis, on a method in which an operator must make a visual judgment.

Furthermore, it is difficult to disassemble the transparent display plate and the light diffusing plate because these are affixed by the double-sided adhesive tape. This causes problems inasmuch as assembly and modification, afterservice, and the like become difficult.

At the present time it is well understood that batteries such as silver oxide and lithium batteries and the like have an adverse effect on the environment, therefore a second look is being taken at clean solar cells, with due consideration to environmental problems.

In this case, examples of a fixing structure by which solar cells and the display plate are fixed to the movement include, for example, a structure wherein the color of the solar cell itself is used to full advantage by exposing the solar cell, a structure wherein the time characters or the like are printed directly onto the surface of the solar cell, or a structure wherein a transparent seal onto which an ornament has been printed is affixed to the solar cell. These structures are fixed by a solar cell fixing member.

Other structures have also been proposed such as a structure wherein the solar cell is fixed by inserting an ornamental parting plate into the external periphery of the solar cell, and pressing a parting plate pin into the watch movement while supporting the solar cell by means of this parting plate; and a structure wherein the light transmitting display plate is incorporated when the watch outer casing is mounted and the light transmitting display plate is maintained by the outer casing.

Next, this type of conventional solar cell and display plate fixing structure will be explained with reference to the drawings.

FIG. 28 is an outline of a sectional view showing the case in which a transparent seal is used. In this drawing, a transparent seal 151, on which an ornament has been printed, is fixed by being affixed to the upper surface of a solar cell 140, except for a shaft section 152 which supports the hands of the watch. The solar cell 140 to which is affixed the transparent seal 151 is securely connected to a movement 110 by means of a solar cell fixing member 153.

FIG. 29(*a*) is an outline of a sectional view of a watch with a solar cell and a parting plate and FIG. 29(*b*) is a plan view. In these drawings, a fixing pin 154*a* on a parting plate 154 on which an ornament is printed engages a plurality of holes 110*a* set in a flange section of the movement 110, to incorporate the parting plate 154 and interpose the solar cell 140 between the parting plate 154 and the movement 110, thereby fixing the solar cell 140 to the movement 110.

FIG. 30 is an outline of a sectional view showing the case where a light transmitting display plate is maintained by an outer casing. A light transmitting display plate 160 is incorporated at the same time as an external casing 155 is mounted on the completed movement 110 incorporating the solar cell 140 and a solar cell fixing member 153 which positions the solar cell 140. The light transmitting display plate 160 is fixed by the external casing 155 when the watch is completely assembled.

However, with the structure shown in FIG. 28, when a defect is found in the transparent seal after the watch has been fully assembled, it is difficult to change only the affixed transparent seal but rather the entire assembly up to the expensive solar cell must be replaced. With the fully assembled movement it is difficult to increase the variety of products, and in addition, it is difficult to reattach the affixed seal. Therefore, the workability is poor and productivity is reduced. This means that the cost of the structure shown in FIG. 28 could be high.

Also, there are significant restrictions in the design of the structure shown in FIG. 29 because the color of the solar cell is determined as mentioned above, so the product is not very attractive even if only the design of the parting plate is changed.

Also, the structure shown in FIG. 30 is unstable in the interval from when the hands are attached until the casing is mounted inasmuch as the position of the light transmitting display plate has not been decided. There is therefore the drawback of extremely poor workability and handling.

Accordingly, an object of the present invention is to provide, with due consideration to the drawbacks of such conventional watches, a watch with a light transmitting display plate wherein, by positioning the light transmitting display plate on the cell which is an EL element or a solar cell or the like, considerable product variety is obtained, and anyone can position the transmitting display plate using a simple operation, and in addition, the operations of mounting and dismounting the transmitting display plate relative to the support frame are easily performed.

Watches using conventional EL elements are disclosed in U.S. Pat. No. 4,775,964, Japanese Patent Laid Open Publication Nos. 291192/1992 and 248088/1991, and others.

The display section of the above-mentioned U.S. Pat. No. 4,775,964 and Japanese Patent Laid Open Publication No. 291192/1993 will now be explained.

FIG. 31 is a sectional view showing a display section described in U.S. Pat. No. 4,775,964. In this display section, a symbol 121 illustrating the time or the like, referred to as time characters, is formed directly on the upper surface of an EL element 130 formed on the upper surface of a movement 110 by a printing method or the like.

However, in the case of the display section shown in FIG. 31, because the symbol 121 is formed directly on the upper surface of the EL element 130, the appearance of the display section is poor so that the value of the goods decreases. There is also the problem that the color of the display section is limited to the color of the EL element 130 (generally a cream color).

A display section in which this problem is eliminated is proposed in Japanese Laid Open Patent Application No. 291192/1992. A sectional view of this display section is shown in FIG. 32. In this display section, a metal layer 131 and a transparent display plate 120 are formed as successive laminations on the EL element 130. The symbol 121 illustrating the time is provided on the transparent display plate 120. Here, the metal layer 131 is formed by coating a metal such as gold or silver or the like on the EL element 130. In this case the transparent display plate 120 is mounted directly on the EL element 130 via the metal layer 131.

In the case of the display section shown in FIG. 32, the freedom of the presentations of the display section and of the color is improved in comparison with the configuration shown in FIG. 31. However, there is a problem inasmuch as the light from the EL element 130 is blocked by the metal layer 131, and the display section is darkened.

The color of the display section is determined by the color of the EL element 130 and the metal layer 131 when the EL element 130 is emitting light, and by the color of the metal layer 131 when the EL element 130 is not emitting light. Freedom in color is therefore insufficient.

In addition, in a structure such as shown in FIG. 32, the transparent display plate 120 and the EL element 130 are held in close contact via the metal layer 131. Therefore, a Newton ring or the like is produced by the refraction of the light at the surface of the junction. This causes the presentation to be worsened.

The display section of a watch using a solar cell such as shown in FIG. 30 also generates a Newton ring or the like because the transparent plate 160 is positioned directly on the upper surface of the solar cell 140, so that the converging efficiency is poor.

In this manner, because in a conventional display section a transparent display plate is mounted directly on the upper surface of the EL element or the solar cell or the like, the colors in the display section are limited to those of the EL element or the solar cell, in addition, light interference fringes such as Newton rings which are produced by refraction of the light at the connecting surface of the EL element, the solar cell, and the display panel caused a problem inasmuch as the presentation and the converging efficiency becomes very bad.

Accordingly, another object of the present invention is to provide a watch with a light transmitting type display plate which can be easily changed by positioning a transparent or opaque display plate on the upper surface of the EL element or the solar cell at a specified gap, thereby preventing the development of a Newton ring or the like and providing superior converging efficiency, excellent appearance, sufficient freedom for the color, and a clear display section.

DISCLOSURE OF THE INVENTION

In the present invention, in a watch wherein a cell made up of a light-emitting member, such as an EL element, or of a light-absorbing member, such as a solar cell, is laminated onto a movement and fixed to a support member, a light transmitting type display plate is arranged on the cell made up of the EL element or the solar cell, and, positioning sections of the shape, for example, a projecting shape or an indented shape, are formed on the light transmitting type display plate and the support member, so that the light transmitting type display plate is integrally fixed to the cell by the engagement of these positioning sections.

Also, in the present invention, in a watch wherein a cell made up of a light-emitting member, such as an EL element, or of a light-absorbing member, such as a solar cell, is laminated onto a movement and fixed to a support member, a light transmitting type display plate is arranged on the cell made up of the EL element or the solar cell, and, positioning sections made up of, for example, a projection and a hole, are formed on the light transmitting type display plate and the movement, so that the light transmitting type display plate is fixed by the engagement of the positioning section through the cell.

As a result, there can be a wealth of variations in the display section of the watch, the display section can be easily fixed, and the workability during assembly and disassembly can be considerably improved.

In the present invention, the light transmitting type display plate is positioned to form a gap at the cell made up of the EL element or the solar cell to prevent light interference fringes of a Newton ring or the like.

This gap is formed by providing an irregularity on the contact surface of the light transmitting type display plate and/or the cell or by providing a spacer at the outer peripheral section between the light transmitting type display plate and the cell.

As a result, the development of light interference fringes of a Newton ring is prevented, the converging efficiency is high, the presentation is good, and the freedom of the color is high, so that a clear display section can be obtained. In addition, the display plate can be changed and various colors and ornamentations can be enjoyed.

DESCRIPTION OF THE DRAWINGS

FIG. 29(*b* ) is a plan of a sectional view of the second conventional example.

DETAILED DESCRIPTION OF THE PREFERRED EMBODIMENTS

Figure 1:
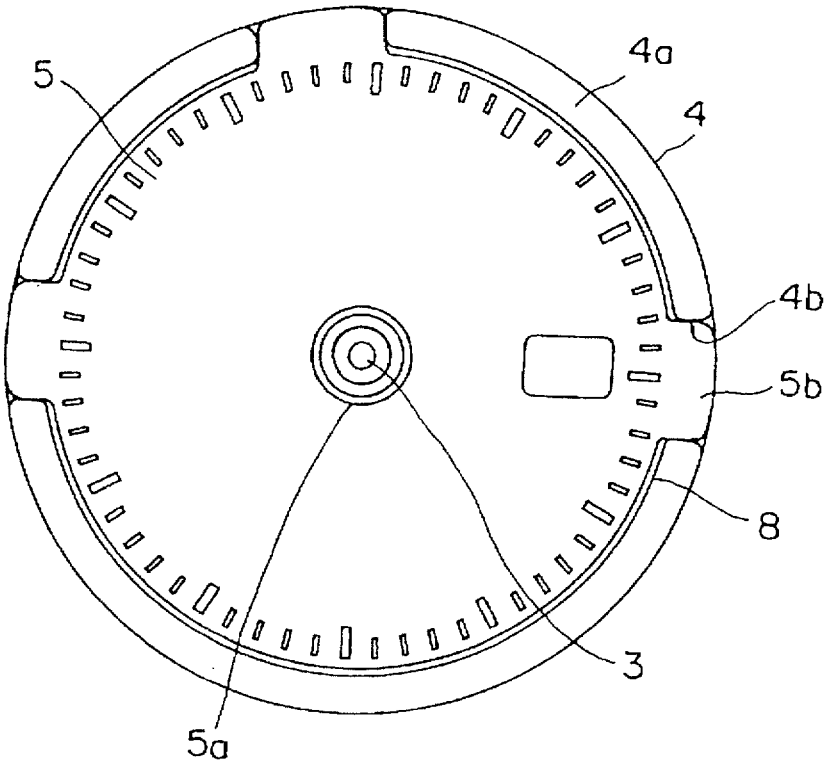
FIG. 1 is a plan view of a first embodiment of the present invention, with the outer casing of the watch omitted.
Figure 2:
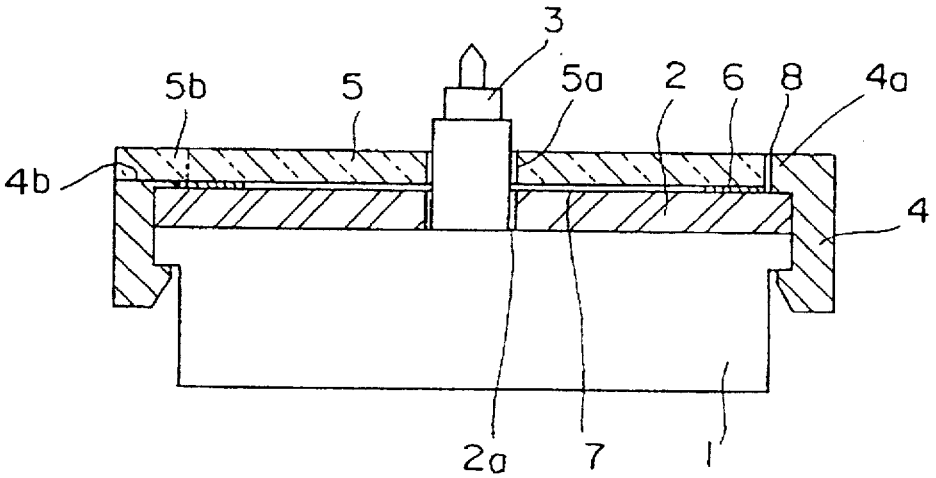
FIG. 2 is an outline of a sectional view of the first embodiment of the present invention, with the outer casing of the watch omitted.

FIG. 1 and FIG. 2 are a plan view and an outline of a sectional view respectively of a first embodiment of the present invention, with the outer casing of the watch omitted.

In this first embodiment of the present invention, a cell 2, which is formed by a light emitting member such as an EL element or the like, or a light absorbing member such as a solar cell or the like, is mounted on the upper surface of a movement 1. The cell 2 and the movement 1 have almost the same plane shape, and are provided with a hole 2*a* in the central section through which a shaft 3 for carrying the hands extends.

A support member 4 is formed from plastic in the shape of a ring. A flange 4*a* is formed on the upper part of the support member 4, projecting inward. When the support member 4 is positioned on the outer side of the movement 1, the cell 2 is fixed to the upper surface of the movement 1 by clamping the outer edge of the cell 2 between the lower surface of the flange 4*a* and the upper surface of the movement 1.

Indented sections 4*b* as positioning sections are formed as a groove from the inside to the outside on the upper surface of the flange 4*a* of the support member 4. The indented sections 4*b* are formed in three locations on the flange 4*a*. The indented sections 4*b* at two of these three locations are opposedly positioned 180° apart. The indented section 4*b* is formed at the remaining location more or less offset from a location halfway between the two opposing indented sections 4*b*.

A light transmitting type display plate 5 is formed by printing or coating an ornament such as a dial, a pet name, numbers, a pattern, or the like on a transparent or semitransparent plate in the form of a thin plate made from acryl, polycarbonate, ceramic, or the like. A transparent plate 5 (hereinafter this term is used to include both A transparent and a semitransparent plate), which forms the light transmitting type display plate, is provided with a hole 5*a* in the central section through which the shaft 3 for carrying the hands extends. Projecting sections 5*b* are formed as positioning sections on the flange section projecting toward the outside in three locations corresponding to the indented sections 4*b* formed on the flange 4*a* of the support member 4.

The watch with this configuration is assembled as follows.

First, the transparent plate 5 is mounted on the upper surface of the cell 2. At this time, a spacer 6 formed in the shape of a ring along the outer periphery of the transparent plate 5 is interposed between the cell 2 and the transparent plate 5 so that a gap 7 is formed between the cell 2 and the transparent plate 5 to prevent the production of light interference fringes such as a Newton ring or the like between the two.

The gap 7 between the cell 2 and the transparent plate 5 can also be formed simply by providing an elevated bottom surface of the indented section 4*b* of the support member 4 (see the left side section of FIG. 2).

The sections 5*b* projecting to the outer periphery of the transparent plate 5 engage the indented sections 4*b* of the support member 4 for positioning. The positioning at this time can be visually performed very easily and accurately by an operator if the positions of the projecting section 5*b* and the indented section 4*b* respectively are in good conformation.

Next, the transparent plate 5 is pressed downward, and is firmly fixed to the top surface of the cell 2 through the spacer 6. At this time, the fixing operation can be easily performed when the dimensions of the transparent plate 5 and the support member 4 are set so that a gap 8 is produced in the diametrical direction between the outer periphery of the section other than the projecting section 5b of the transparent plate 5, which is the light transmitting type display plate, and the inner periphery of the support section 4, even when there is a slight dimensional error in the two.

In this manner, the transparent plate 5, which is the light transmitting type display plate, can easily be fixed to the support member 4 by the engagement of the indented sections 4b and the projecting sections 5b. Furthermore, because the indented sections 4b and the projecting sections 5b are each formed in three locations, the engaged transparent plate 5 will not rotate or slip from the groove even when force is applied in the horizontal direction.

In addition, if the outer edges of the projecting sections 5b of the transparent plate 5 are pressed upward with a pair of tweezers or the like so that the engagement of the projecting sections 5b and the indented sections 4b is broken, the transparent plate 5 can be easily removed from the support member 4.

In the above-described embodiment, there are three indented sections 4b of the support member 4 and three projecting sections 5b of the transparent plate 5. However, it is also acceptable for two or four or more of each to be formed. In these cases also, by providing at least one of the indented sections 4b and the projecting sections 5b slightly offset so as to be asymmetrical (for example, in the case of two, positioned at 12 o'clock and at 7 o'clock), the directional matching and the positioning of the transparent plate 5, which is the light transmitting type display plate, with respect to the support plate 4 is easier.

Figure 3:
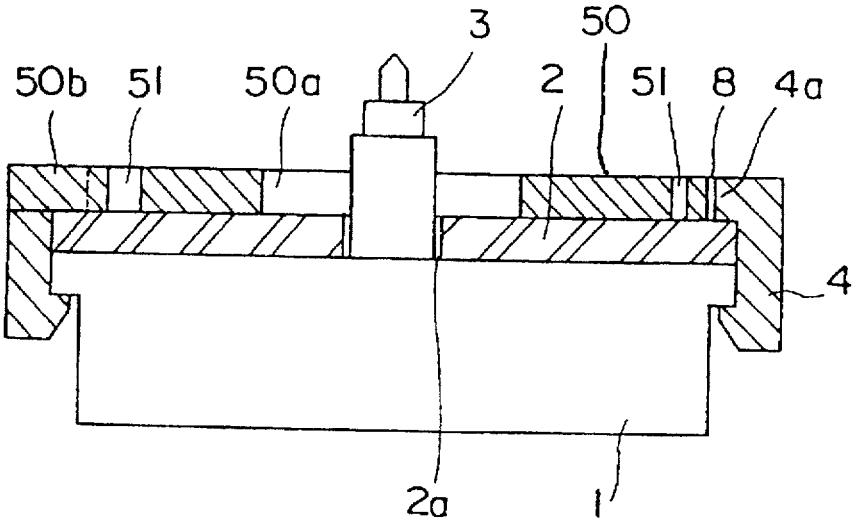
FIG. 3 is an outline of a sectional view of a second embodiment of the present invention, with the outer casing of/the watch omitted.

FIG. 3 is an outline of a sectional view of a second embodiment of the present invention, with the outer casing of the watch omitted.

The watch of this second embodiment uses a metal plate, which has a surface treated by plating or coating, as a light transmitting type display plate 50. One part or all of the ornamental sections such as the dial, numbers, patterns, and the like is formed by means of a hole 50a through which the shaft supporting the hands penetrates and through-holes 51, and light is transmitted through the hole 50a and the through-holes 51.

Specifically, in the case where the cell 2 is an EL element, the light from the EL element passes through the hole 50a and the through-holes 51 and is transmitted to the surface of the display plate. When the cell 2 is a solar cell, sunlight passes through the hole 50a and the through-holes 51 and is transmitted to the solar cell on the lower surface of the display plate. When the light transmitting type display plate is formed as the metal plate 50 in this manner, a large area is provided to the through-holes 51 and the hole 50a on which the ornamental section is formed. With the exception of the section 50b projecting to the outer periphery of the display plate and the like, the configuration is the same as for the first embodiment.

Also, in the case where the light transmitting type display plate is formed as the metal plate 50, when the metal plate 50 is mounted on the upper surface of the cell 2, it is not necessary to provide a gap between the metal plate 50 and the cell 2, therefore it is not necessary to interpose a spacer between the two. Accordingly, the operating procedure to fix the metal plate 50, which is the light transmitting type display plate, to the upper surface of the cell 2 is the same as for the first embodiment with the exception of the operation to interpose the spacer.

Figure 4:
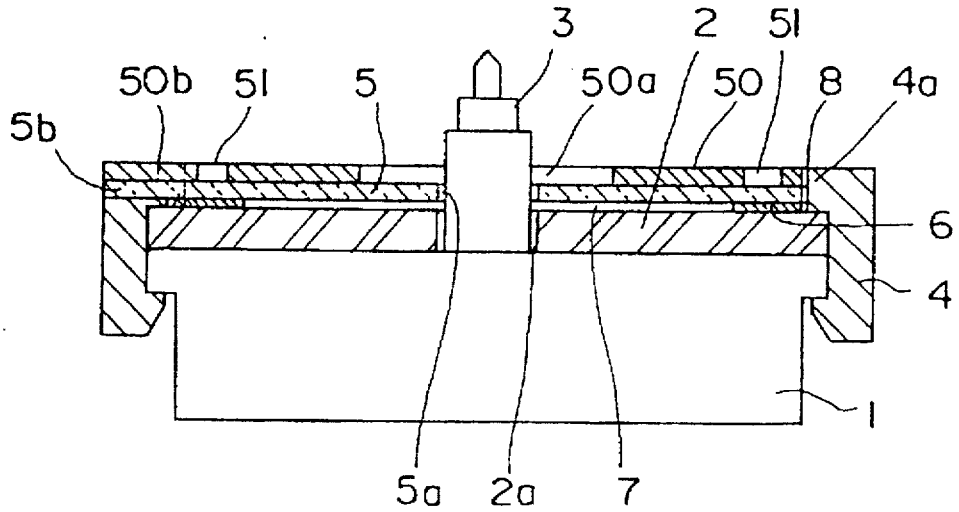
FIG. 4 is an outline of a sectional view of a third embodiment of the present invention, with the outer casing of the watch omitted.
Figure 5:
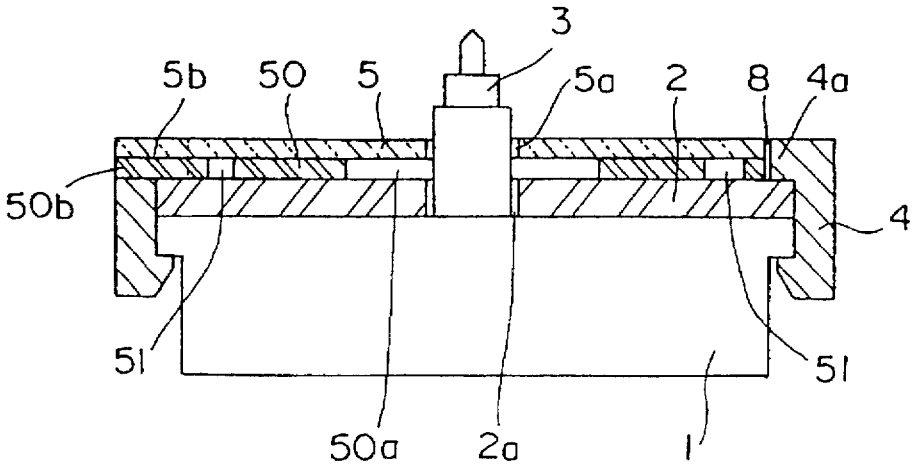
FIG. 5 is an outline of a sectional view of a fourth embodiment of the present invention, with the outer casing of the watch omitted.

The light transmitting type display plate may also be formed by laminating the transparent plate 5 and the metal plate 50, and, as in a third embodiment shown in FIG. 4, the metal plate 50 is laminated onto the transparent plate 5 as explained for the first embodiment, or as in a fourth embodiment shown in FIG. 5, the transparent plate 5 is laminated onto the metal plate 50 as explained for the second embodiment. In these cases also, the projecting sections 5b and 50b project to the outer periphery of the transparent plate 5 and the metal plate 50 respectively, and engage the indented sections 4b of the support member 4 to fix the plates.

Figure 6:
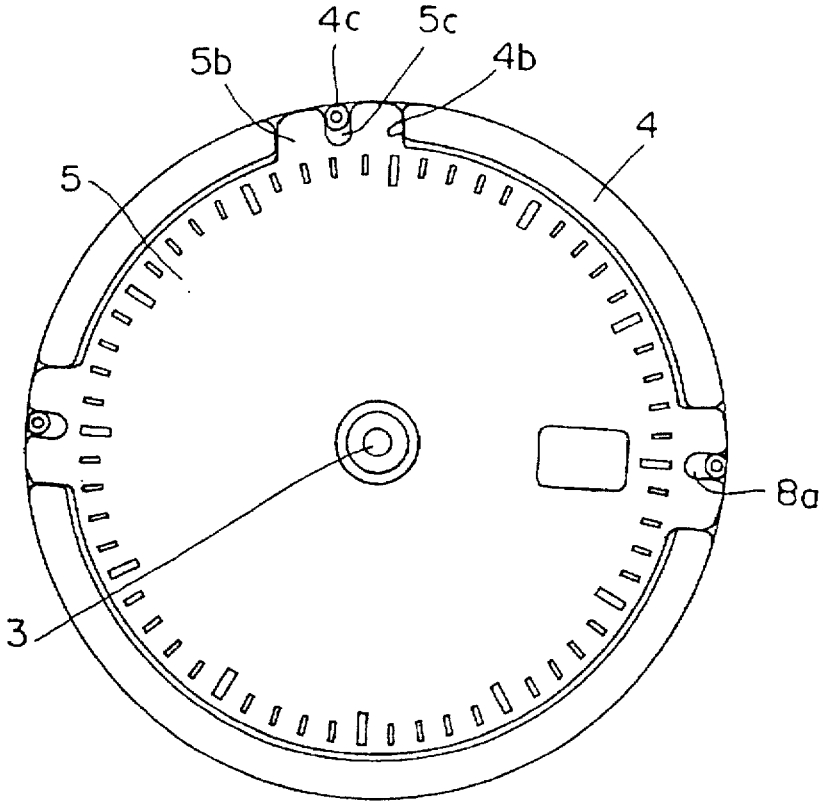
FIG. 6 is a plan view of a fifth embodiment of the present invention, with the outer casing of the watch omitted.
Figure 7:
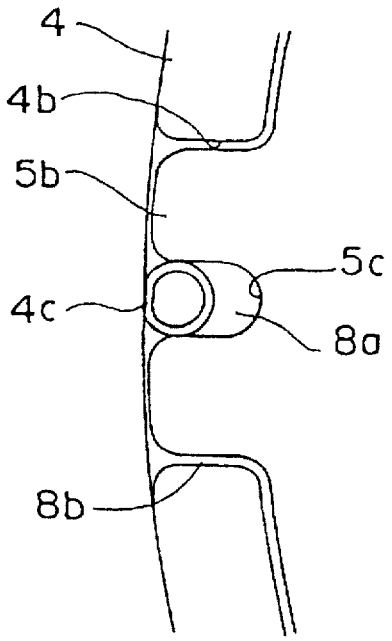
FIG. 7 is an enlarged plan view of the principal parts of the fifth embodiment of the present invention, with the outer casing of the watch omitted.
Figure 8:
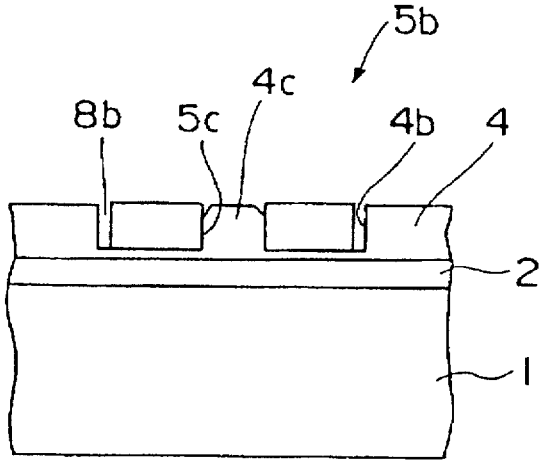
FIG. 8 is an enlarged side elevation of the principal parts of the fifth embodiment of the present invention, with the outer casing of the watch omitted.

FIG. 6 to FIG. 8 are a plan view, an enlarged plan view of the principal parts, and an enlarged side elevation of the principal parts respectively of a fifth embodiment of the present invention, with the outer casing of the watch omitted.

The watch of this fifth embodiment is provided with notched sections 5c which are outward-facing openings almost in the center of the projecting sections 5b, and the positioning sections of the transparent plate 5 as the light transmitting type display plate, and which extend from the upper surface to the lower surface of the projecting sections 5b. In addition, projections 4c which engage the notched sections 5c project in the indented sections 4b of the support member 4 almost at the center.

In this case, the notched sections 5c of the projecting sections 5b are deep, and a gap is formed relative to the projection 4c. Specifically, by forming a gap 8a similar to the gap 8 between the outer periphery of the transparent plate 5 and the inner periphery of the support member 4, the transparent plate 5 is easily fixed in the same manner as in the above-described case.

In this embodiment, the transparent plate 5, which is the light transmitting type display plate, is solidly fixed to the support member 4c by the engagement of the notched sections 5c of the projecting section 5b with the projections 4c of the indented section 4b. Accordingly, as shown in FIG. 7 and FIG. 8, the width of the projecting section 5b is less than the width of the indented section 4b, so that it is possible to form a gap 8b between them. As a result, an unsatisfactory engagement does not occur even when there is a slight dimensional error between the projecting section 5b and the indented section 4b, and an easier fixing operation is possible along with the presence of the previously described gaps 8, 8a.

The fifth embodiment can be applied to the case where the light transmitting type display plate is made up of the metal plate 50 as in the case of the second embodiment or to the case where the transparent plate 5 and the metal plate 50 are laminated as in the cases of the third and fourth embodiments.

The projecting sections in which the notched sections 5c, 50c are formed and the indented sections in which the projections 4c are formed can also be partly formed in the projecting sections 5b, 50b and the indented section 4b, respectively. The number and position can be suitably selected depending on the number of the positioning sections.

Figure 9:
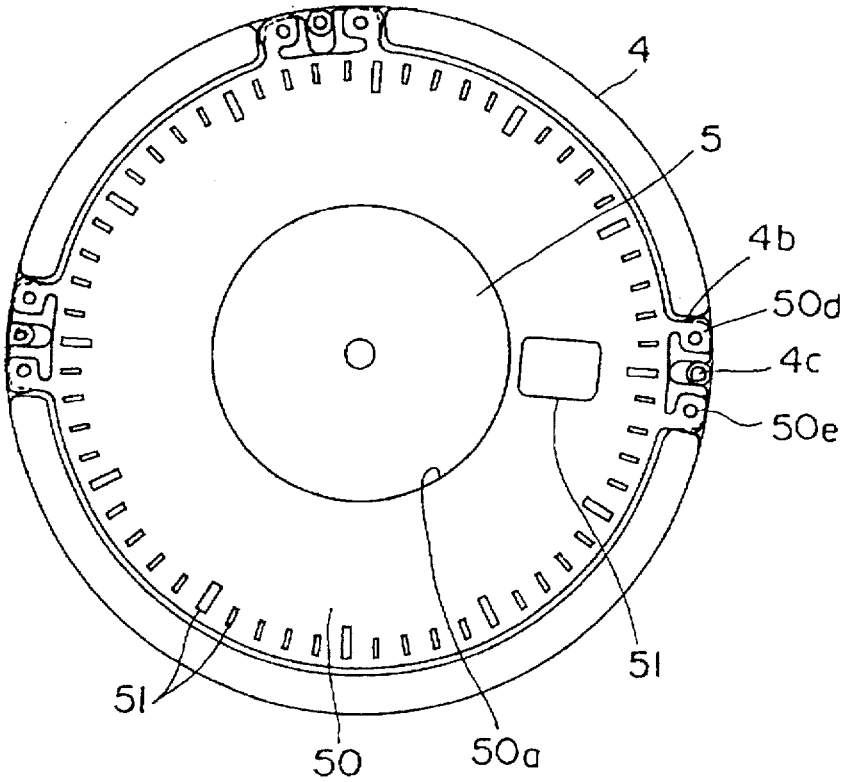
FIG. 9 is a plan view of a sixth embodiment of the present invention, with the outer casing of the watch omitted.
Figure 10:
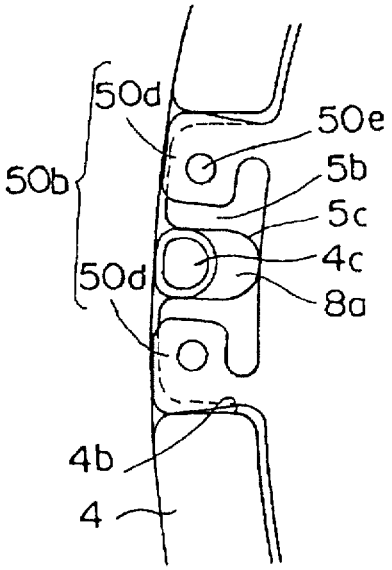
FIG. 10 is an enlarged plan view of the principal parts of the sixth embodiment of the present invention, with the outer casing of the watch omitted.
Figure 11:
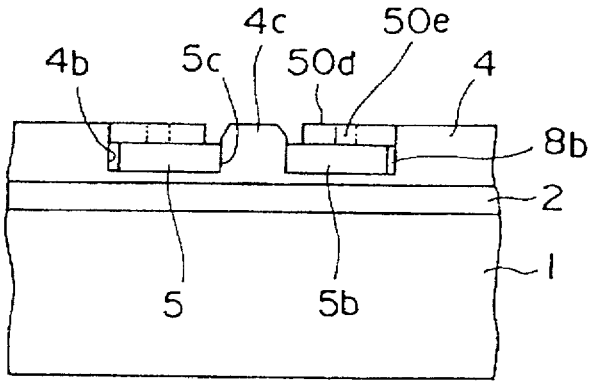
FIG. 11 is an enlarged side elevation of the principal parts of the sixth embodiment of the present invention, with the outer casing of the watch omitted.

FIG. 9 to FIG. 11 are a plan view, an enlarged plan view of the principal parts, and an enlarged side elevation of the principal parts respectively of a sixth embodiment of the present invention, with the outer casing of the watch omitted.

The watch of this sixth embodiment has a metal plate 50 laminated onto the upper surface of the transparent plate 5 shown in the third embodiment as the light transmitting type display plate and is an example wherein the following design is adopted in the positioning section of a light transmitting type display plate. That is, the projecting section 5*b* of the transparent plate 5 is provided with a notched section 5*c* almost in the center of the projecting section 5*b*, similar to the positioning section in the fifth embodiment, and is formed to engage the projection 4*c* of the indented section 4*b* of the support member.

On the other hand, as the positioning section of the metal plate 50, a projecting section 50*b* is formed from two projecting leaves 50*d* and a notch is made in the root section facing the projecting leaves 50*d*. The projecting leaves 50*d* are made to bend inward by the elasticity of the metal. A small through hole 50*e* is formed in the tip section of each of the two projecting leaves 50*d*.

To fix the light transmitting type display plate in this case, first, with the notched section 5*c* of each projecting section 5*b* of the transparent plate 5 engaging the projection 4*c* of each indented section 4*b* of the support member 4, the projecting sections 5*b* are caused to engage the indented sections 4*b* so that the transparent plate 5 is fixed to the support member 4. Next, the two projecting leaves 50*d* of each projecting section 50*b* of the metal plate 50 are pushed in each indented section 4*b* of the support member 4 while bending inward, so that the metal plate 50 is fixed to the support member 4 which is laminated onto the upper part of the transparent plate 5. By this means the light transmitting type display plate made up of the transparent plate 5 and the metal plate 50 is integrally fixed to and supported on the support plate 4.

Specifically, as shown in FIG. 10 and FIG. 11, the projecting leaves 50*d* are solidly fixed in the indented sections 4*b* because the outer surfaces of the projecting leaves 50*d* apply outward pressure to the inside surfaces of the indented sections 4*b*.

In disassembling the metal plate 50, the projecting leaves 50*d* are pressed upward using a pair of tweezers or the like, to remove each of the pressed-in projecting leaves 50*d* from the indented section 4*b*. The removal of the metal plate 50 is made even easier by inserting the ends of the tweezers into the holes 50*e* in each of the projecting leaves 50*d* to squeezing them, thereby bending the indented section 4*b* inward to break the engagement of the projecting leaves 50*d*.

Figure 12:
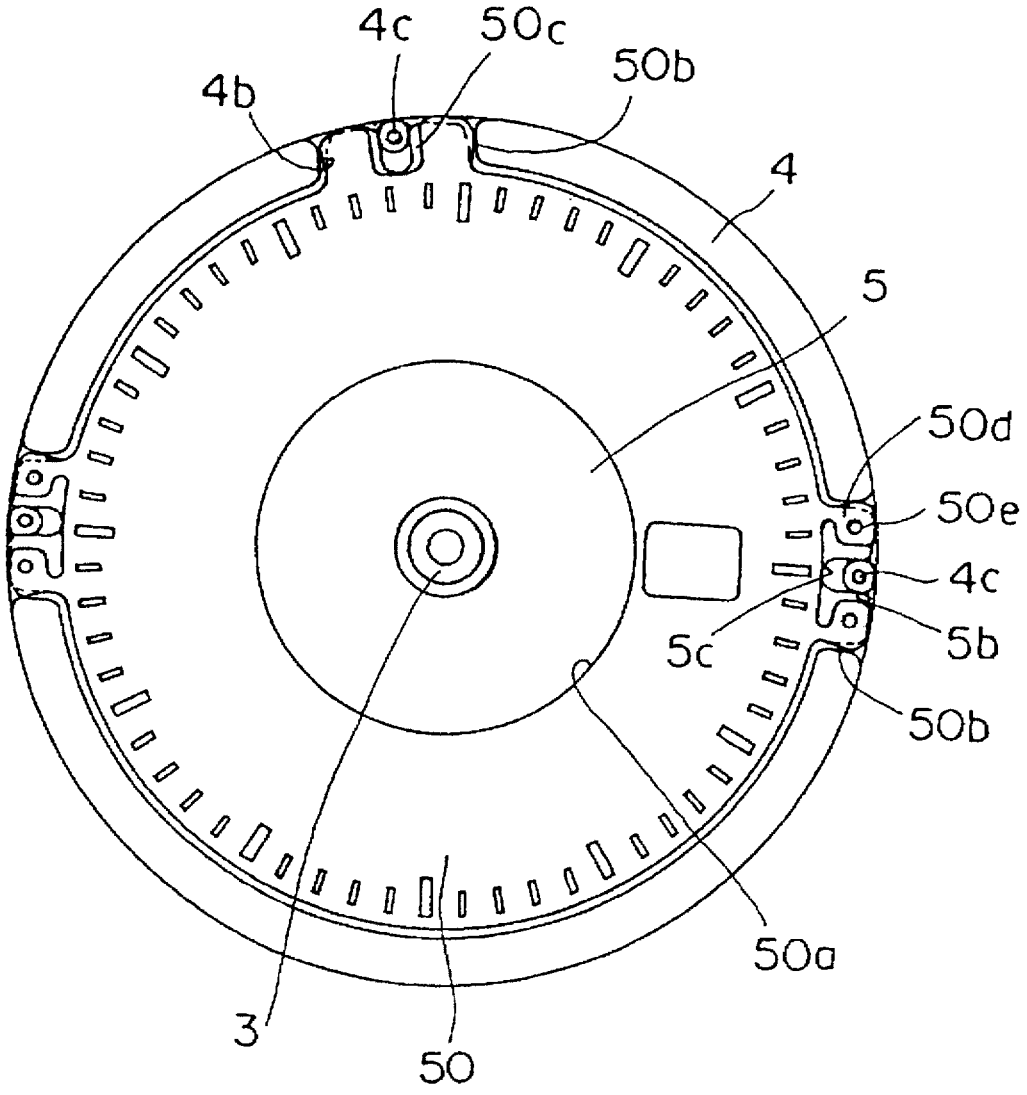
FIG. 12 is a plan view of a seventh embodiment of the present invention, with the outer casing of the watch omitted.

FIG. 12 is a plan view of a seventh embodiment of the present invention, with the outer casing of the watch omitted. The watch of the seventh embodiment represents a further improvement over the sixth embodiment. Among the projecting sections 50*b* of the metal plate 50, two projecting leaves 50*d* are formed on two corresponding and opposed projecting sections 50*b* , as in the sixth embodiment, and a notch 5*c* is formed almost at the center of the remaining projecting sections 50*b* , as in the fifth embodiment.

In the seventh embodiment, the shapes of the two projecting leaf type projecting sections and the one remaining notched type projecting section are clearly different. Therefore if an assembly operator knows which of the indented sections of the support member 4 is engaged by the notched projecting section, no mistake is made in the corresponding relationship of the indented sections 4*b* and the projecting sections 50*b* , so that it is possible to quickly engage and fix the metal plate 50 in the support member 4.

In this case, it is desirable that a clear difference can be observed in the shapes of the two projecting leaf type projecting sections and the one remaining notched type projecting section. If this is done, the positioning, engaging, and fixing of the metal plate 50 can be performed still more precisely and quickly.

The number and positions of the projecting leaf type projecting sections and the notched type projecting sections can be suitably changed according to the number of positioning sections provided in the metal plate 50, specifically, the number of projecting sections.

Figure 13:
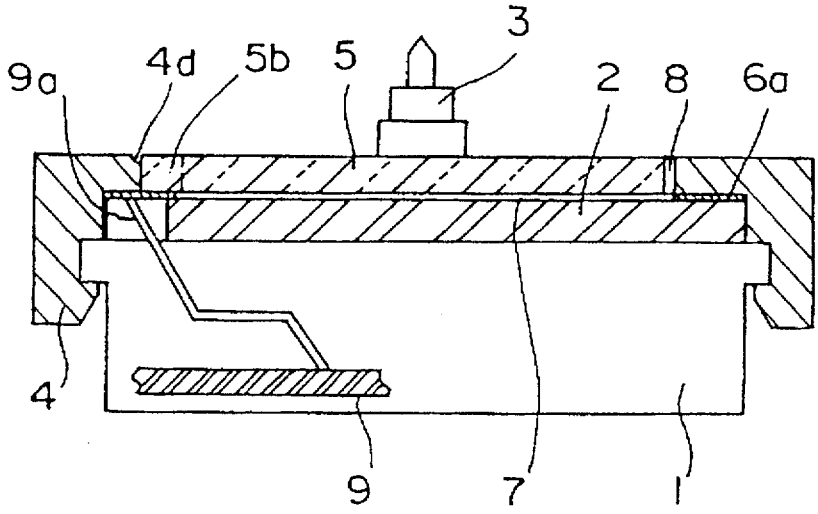
FIG. 13 is an outline of a sectional view of an eighth embodiment of the present invention, with the outer casing of the watch omitted.
Figure 14:
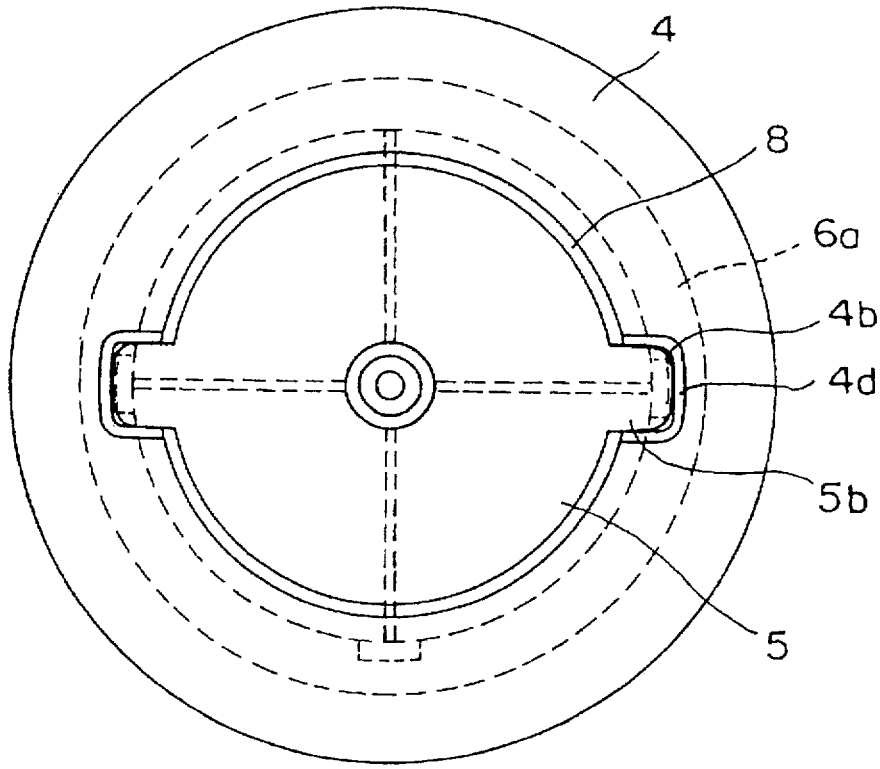
FIG. 14 is a plan view of the eighth embodiment of the present invention, with the outer casing of the watch omitted.

FIG. 13 and FIG. 14 are a sectional view and a plan view respectively of an eighth embodiment of the present invention, with the outer casing of the watch omitted. This watch of the eighth embodiment has a configuration which uses a solar cell as the cell 2 and the transparent plate 5 as the light transmitting type display plate.

The solar cell 2 is positioned on the upper surface of the movement 1 by means of a positioning pin (not shown in the drawing) provided on the hands shaft 3 side of the movement 1. Then, the solar cell 2 is interposedly fixed on the movement 1 by the support member 4. A ring-shaped heat application sheet 6*a* is applied by pressure to the upper surface of the solar cell 2. The projecting section 5*b* formed on the outer periphery of the transparent plate 5 is fixed by being lightly pressed into the indented section 4*b* formed on the support member 4. In addition, the heat application sheet 6*a* and the circuit substrate 9 are connected by a connecting spring 9*a*.

A gap 8 is provided between the outer peripheral section other than the projecting section 5*b* of the transparent plate 5 and the outer peripheral section other than the indented section 4*b* of the support member 4, so that deformation from a variation in dimensions is prevented during assembly.

In addition, a sloping section 4*d* is provided in the indented section 4*b* of the support member 4 to allow smooth incorporation of the transparent plate 5. The sloping section 4*d* may also be provided on the bottom surface of the projecting section 5*b* of the transparent plate 5, not on the solar cell fixing member, or may be provided on both of these.

Also, in this embodiment, in order to prevent the development of a Newton ring from refraction of the light at the surface of the joint between an upper surface protective film on the solar cell 2 and the transparent plate 5, the ornamental transparent plate 5 is arranged on the upper surface of the heat application sheet 6*a* affixed to the light-receiving surface of the solar cell 2 as a spacer. In this manner, a gap 7 as thick as the heat application sheet 6*a* is ensured between the transparent plate 5 and the solar cell 2, preventing the formation of a Newton ring at the junction of the transparent plate 5 and the solar cell 2, so that good converging efficiency is obtained. A single member can therefore serve double duty as a heat application sheet and a spacer.

This configuration can be applied even in the case where a light transmitting type display plate which has a metal plate laminated onto the upper surface of a transparent plate is used.

Figure 15:
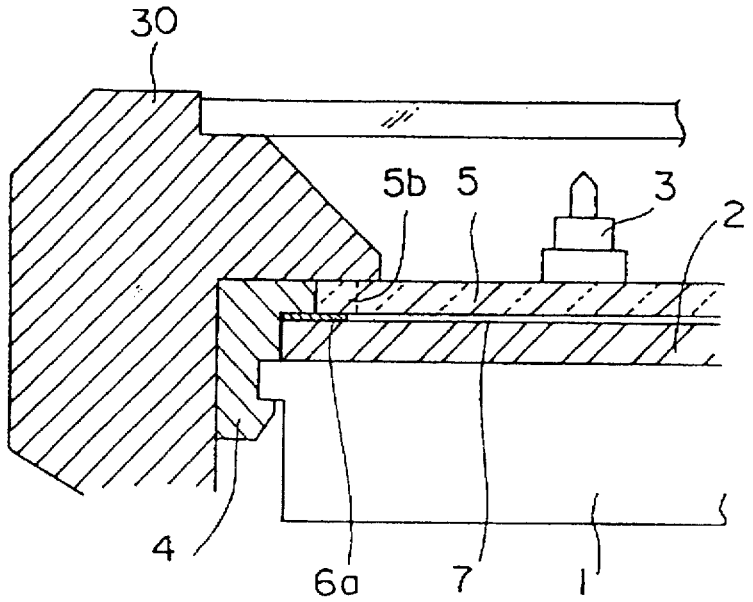
FIG. 15 is an outline of an enlarged sectional view of a completed watch.

FIG. 15 is an outline of a sectional view of a completed watch. In the structure of this embodiment, the integrated completed movement is levelly inserted into an outer casing 30 as far as the transparent plate 5. Accordingly, the floating of the transparent plate 5 in the cross-sectional direction is controlled by the outer casing 30.

This structure in which the support member and the light transmitting type display plate are supported by the outer casing can be applied in the above-mentioned first to eighth embodiments.

Next, other embodiments of a structure which prevents the formation of Newton rings will be explained for the case where the transparent plate is used as the light transmitting type display plate.

Figure 16:
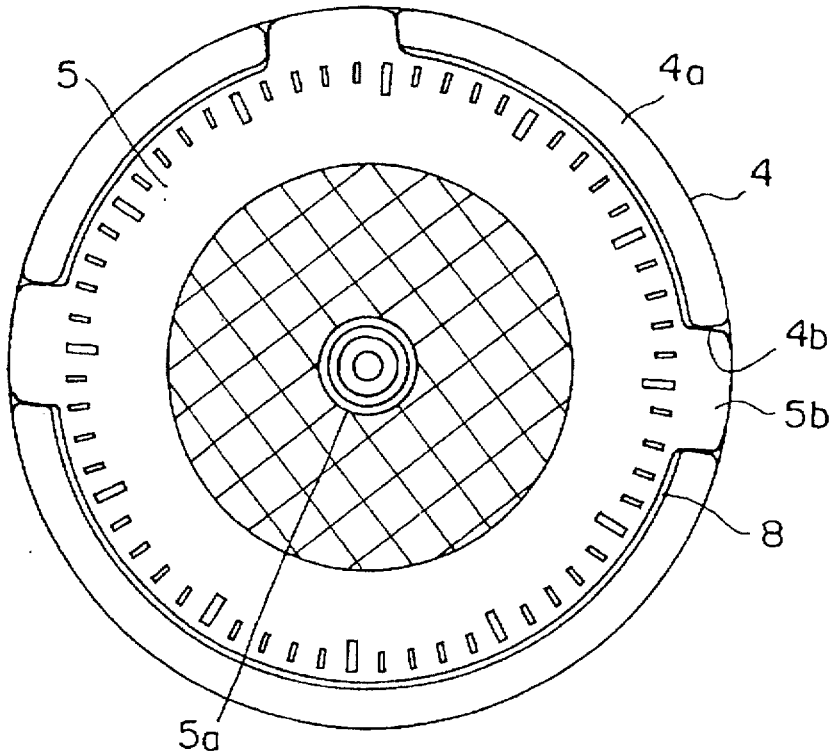
FIG. 16 is a plan view of a ninth embodiment of the present invention, with the outer casing of the watch omitted.
Figure 17:
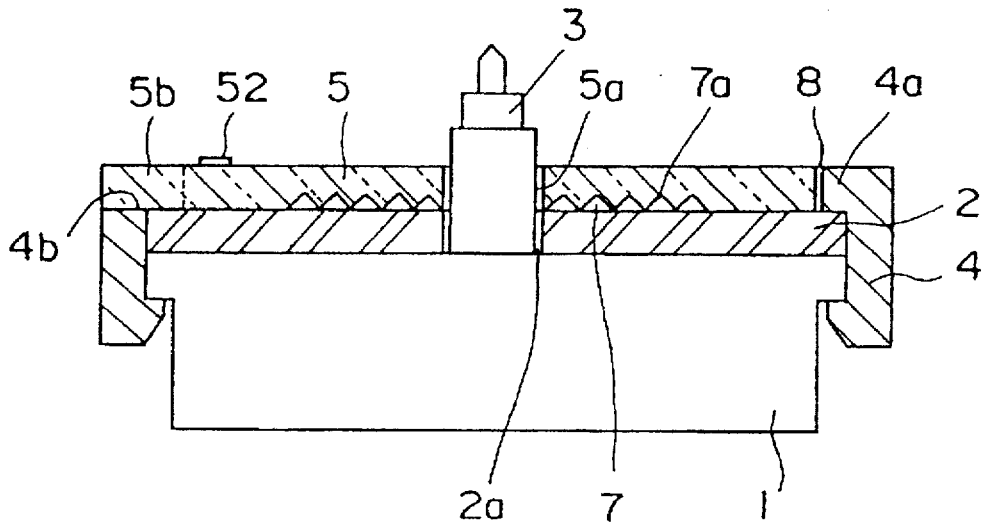
FIG. 17 is an outline of a sectional view of the ninth embodiment of the present invention, with the outer casing of the watch omitted.

FIG. 16 is a plan view and FIG. 17 is an outline of a sectional view of a ninth embodiment of the present invention, with the outer casing of the watch omitted.

In this embodiment the transparent plate 5 which is the light transmitting type display plate is laminated directly onto the upper surface of the cell 2 formed from an EL element or the like.

An irregular section 7*a* is provided on the interface of the transparent plate 5 and the cell 2, and the gap 7 is formed between the cell 2 and the transparent plate 5 by the irregular section 7*a*. In this case, because the irregular section 7*a* gives a pattern to the light transmitting type display plate, the design characteristics are improved. In addition, because the gap 7 prevents the production of light interference fringes such as a Newton ring or the like, there is no decrease in the commercial value due to light interference fringes.

The irregular section 7*a* needs not be only on the lower surface of the transparent plate 5 but may be provided on the upper surface of the cell 2 where it contacts the transparent plate 5, and may also be provided on both the surfaces where the transparent plate and the cell contact each other.

The shape, size, and roughness of the irregular section 7*a* are optional. The irregularity may be like a pear-skin (sprinkled) lacquer. Also, the irregular section 7*a* may be formed on either a part or all of the lower surface of the transparent plate 5, or on a part or all of the upper surface of the cell.

The shape of the irregular section 7*a* is optional. The cross-section of the irregular shape may be triangular, as shown in FIG. 17, or may be another shape such as, for example, rectangular or circular. The shape of the irregular section 7*a* may also be uniform, as shown in FIG. 17, or may be a mixture of a number of different shapes. The irregular section may also be shaped as a character or symbol or the like for showing the time.

There is no restriction on the color of the transparent plate 5. This plate 5 may be transparent or colored, but it must be capable of transmitting light of the EL element. In addition, the entire light transmitting type display plate may be one color or may be made up of a number of different colored regions.

It is possible to obtain a variety of light transmitting type display plates by selecting these elements and by suitably selecting and combining the ornamentation and colors and the like on the transparent plate.

When the transparent plate 5 is used as the light transmitting type display plate, the ornamental section consisting of the dial, numbers, pattern and the like is directly printed on the transparent plate 5, or formed to provide the irregularity. It is possible to display the ornamental section three-dimensionally in this manner.

Figure 18:
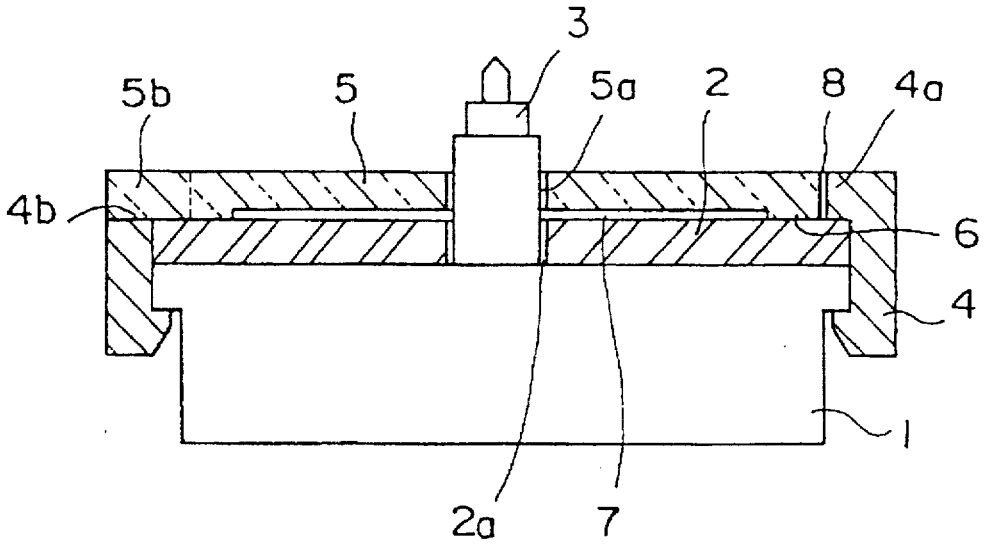
FIG. 18 is a plan view of a tenth embodiment of the present invention, with the outer casing of the watch omitted.

FIG. 18 is a plan view of a tenth embodiment of the present invention, with the outer casing of the watch omitted. This embodiment is constructed so that the spacer 6 is formed over the entire periphery or on one part of the lower surface of the outer periphery of the transparent plate 5, and integrally with the transparent plate 5. As a result, it is not necessary to separately provide a spacer, and the work for interposing the spacer between the cell 2 and the transparent plate 5 can be eliminated.

Figure 19:
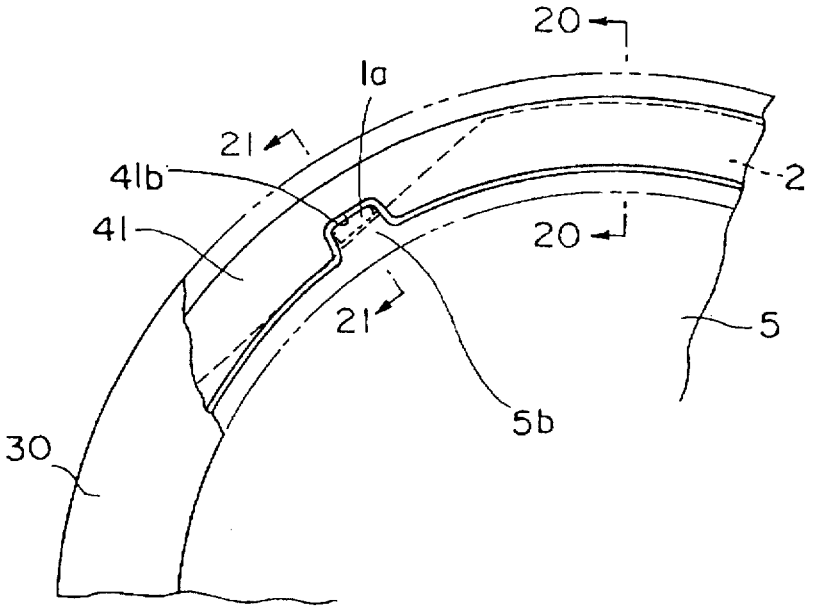
FIG. 19 is a partial plan view of an eleventh embodiment of the present invention.
Figure 20:
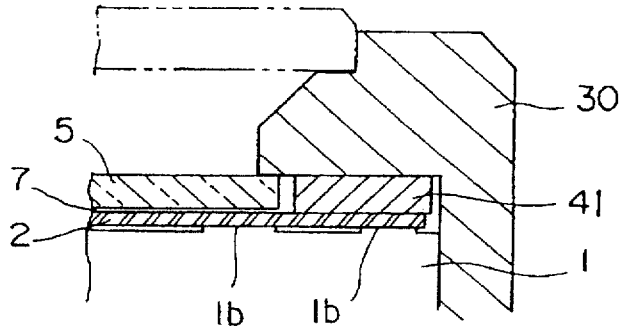
FIG. 20 is view taken along the section 20—20 shown in FIG. 19.
Figure 21:
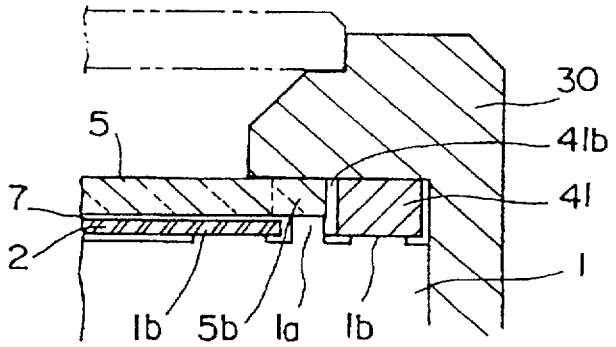
FIG. 21 is view taken along the section 21—21 shown in FIG. 19.

FIGS. 19 to 21 are a partial plan view, a view taken along the section 20—20, and a view taken along the section 21—21 respectively of the main part of an eleventh embodiment of the present invention. In this embodiment, a projection 1*a* is provided integrally on the upper surface of the movement 1 as a spacer, and the cell 2 is fixedly supported on the outer casing 30 through a cell support frame 41. Also, the transparent plate 5 formed as the light transmitting type display plate is fixedly supported directly by the outer casing 30.

Specifically, the cell 2, slightly smaller in diameter than the movement 1 and with a part cut out to correspond to the projecting section 5*b* of the transparent plate 5, is mounted on the upper surface of the movement 1. The cell 2 is mounted on a receiving section 1*b* (omitted from FIG. 19) formed on the upper surface of the movement 1 and the outer peripheral section of the cell 2 is fixed by the outer casing 30 through the cell support frame 41 (see FIG. 20). An indented section 41*b* is formed on a part of the cell support frame 41 corresponding to the projecting section 5*b* of the transparent plate 5.

The projection 1*a* which is higher than the upper surface of the cell 2 is formed on the upper surface of the movement 1 corresponding to the indented section 41*b*. Accordingly, the projecting section 5*b* of the transparent plate 5 engages the indented section 41*b* and is positioned on the upper surface of the projection 1*a*, and produces a gap 7 between itself and the cell 2. Subsequently, when the outer periphery of the transparent plate 5 is interposedly held by the outer casing 30, the transparent plate 5, i.e. the light transmitting type display plate, is supportingly and integrally with the cell 2 fixed by the outer casing 30 (see FIG. 21).

In this case, because the outer casing 30 is wide in the diametrical direction, the projecting section 5*b* of the transparent plate 5 and the indented section 41*b* of the cell support frame 41 are covered by the outer casing 30 so that these cannot be seen externally. This provides good design characteristics.

The ninth, tenth, and eleventh embodiments can be applied in the same manner to watches in which the light transmitting type display plate is fabricated with the metal plate laminated onto the upper surface of the transparent plate.

In the case where the light transmitting type display plate is made up of a transparent plate and a metal plate, and where the metal plate 50 is laminated onto the upper surface of the cell 2, and the transparent plate 5 is laminated onto the upper surface of the metal plate 50, as shown in FIG. 5, a Newton ring or the like does not develop because the metal plate 50 functions as a spacer.

Figure 22:
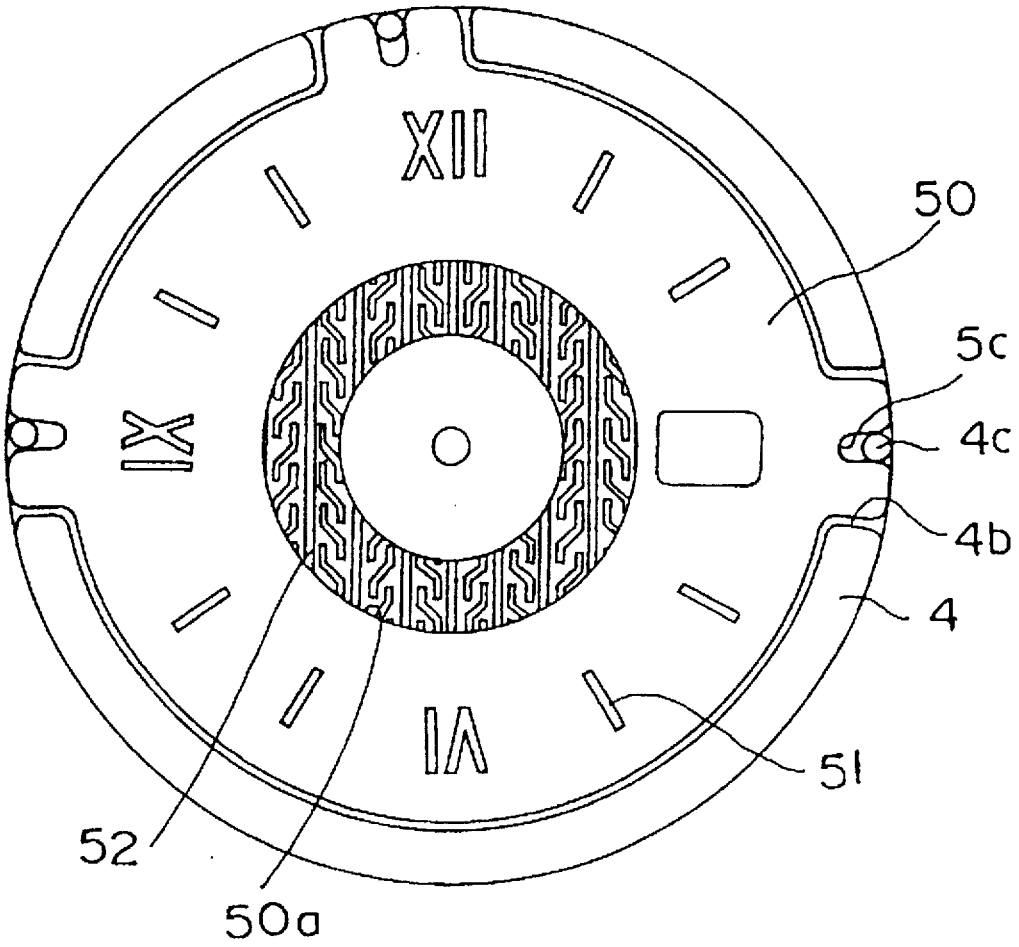
FIG. 22 is a plan view showing an example of a pattern plate set into a center-hole of a metal dial, with the outer casing of the watch omitted.

In addition, in each of the above embodiments, the metal plate can be, optionally, a dial, numbers, or a pattern. For example, as shown in FIG. 22, the light transmission orifice of the pattern can be formed integrally at the center section of the metal plate 50 (the portion corresponding to the hole 50*a* ), or, a pattern plate 52 for implementing light transmission of the above-mentioned pattern can be inserted into the center hole 50*a*.

Next, the fixing structure of a light transmitting type display plate which differs from that of the above-described light transmitting type display plates will be explained.

Figure 23:
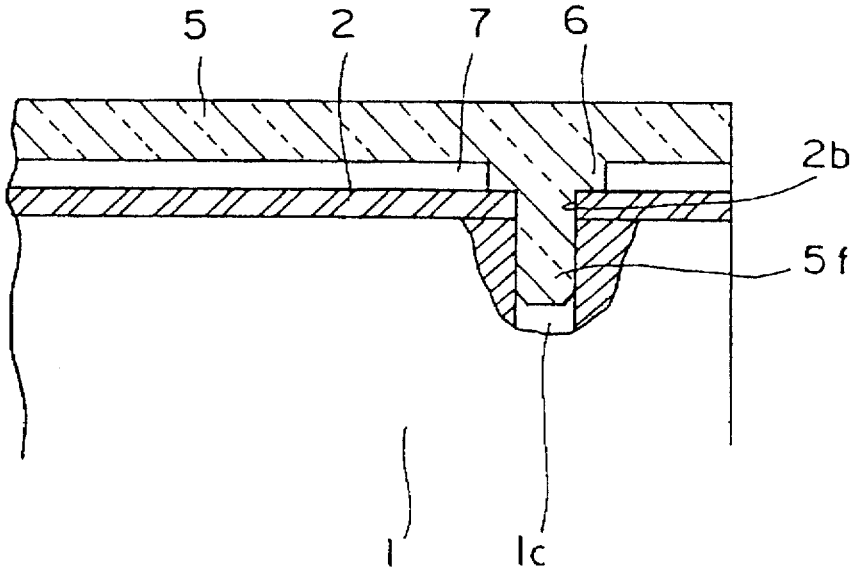
FIG. 23 is an outline of a sectional view of a twelfth embodiment of the present invention, with the outer casing of the watch omitted.

FIG. 23 is an outline of a sectional view of a twelfth embodiment of the present invention, with the outer casing of the watch omitted.

In this embodiment, the cell 2 which is an EL element or a solar cell or the like is mounted on the upper surface of the movement 1, and, in addition, the light transmitting type display plate is arranged above the cell 2. A plurality of installation holes 1*c* is provided, each hole at an optional position on the outer peripheral side of the movement 1, and, through-holes 2*b* are provided at positions on the cell 2 corresponding with the installation holes 1*c*.

Projections 5*f* are provided on the rear surface of the light transmitting type display plate at positions corresponding with the installation holes 1*c* and the through-holes 2*b*. The projections 5*f* pass through the through-holes 2*b* of the cell, and engage the installation holes 1c of the movement 1. As a result, the cell 2 and the light transmitting type display plate are firmly fixed to the movement 1.

In this case, if the light transmitting type display plate is the transparent plate 5, the diameter of the root section of the projections 5f is made large so as to act as a spacer 6, as shown in FIG. 23. Therefore, the gap 7 is formed between the cell 2 and the transparent plate 5 by the spacer 6, and the cell 2 is fixed so that it does not lift away from the movement 1.

The spacer 6 may be formed in a ring shape along the outer periphery of the transparent plate 5.

The transparent plate 5 is prevented from jumping out of the installation hole 1c because the outer periphery is interposedly supported by the outer casing, although this is not shown in the drawings.

In a watch with this embodiment, the formation of a Newton ring or the like is also prevented by the gap 7 between the cell 2 and the transparent plate 5, and further the cell 2 and the transparent plate 5 are easily and reliably fixed.

The number of projections 5 may be optional. For example, in the case of three projections it is possible to have two of them face each other at 180°, and the other one can be positioned slightly offset from the halfway position between the opposed projections 5f. It is also possible for some of projections 5f to have different diameters, for the diameter of the spacer to be changed, or for the spacer to be omitted, so that it is easy to differentiate between the projections 5f, thereby improving the operability during assembly.

Figure 24:
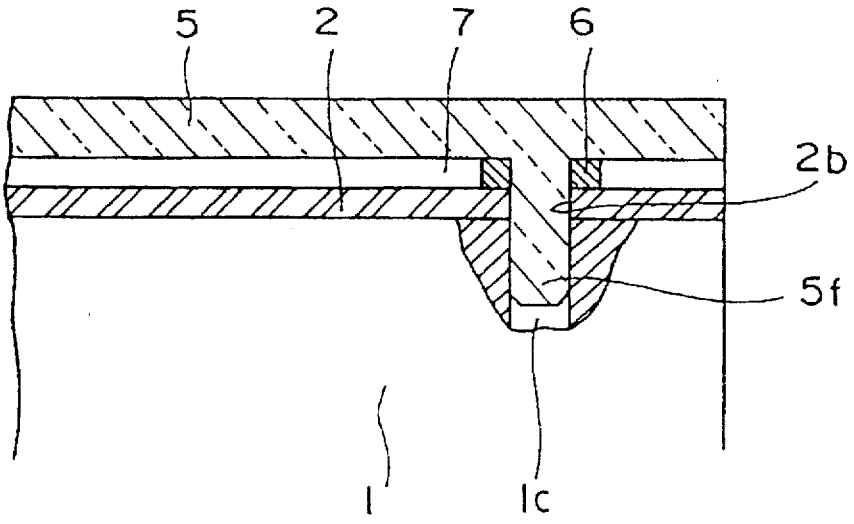
FIG. 24 is an outline of a sectional view of a thirteenth embodiment of the present invention, with the outer casing of the watch omitted.

FIG. 24 is an outline of a sectional view of a thirteenth embodiment of the present invention, which has a configuration wherein the spacer 6 of the twelfth embodiment shown in FIG. 23 is formed separately from the projections 5f. With this configuration, the diameters may differ in accordance with the watch variety, and a spacer 6 of a different shape can be selectively used.

Figure 25:
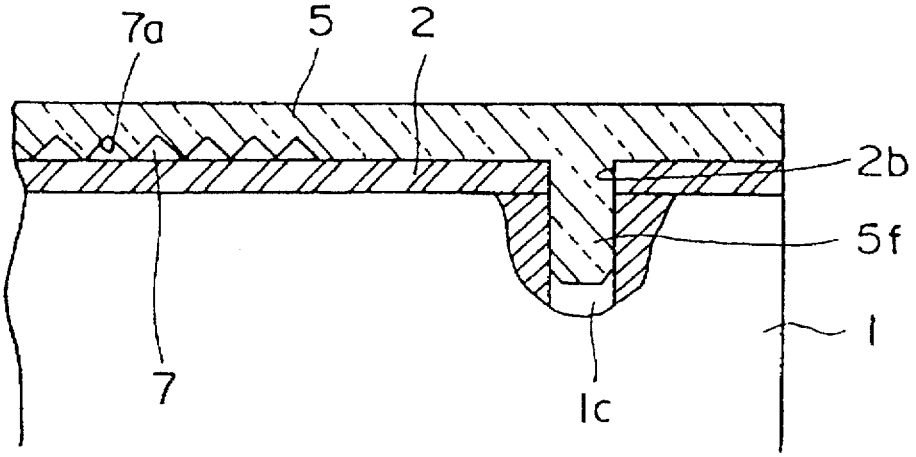
FIG. 25 is an outline of a sectional view of a fourteenth embodiment of the present invention, with the outer casing of the watch omitted.

FIG. 25 is an outline of a sectional view of a fourteenth embodiment of the present invention. In this embodiment the outer casing is eliminated. By providing the irregular surface 7a on the lower surface of the transparent plate 5, the gap 7 is formed between the cell 2 and the transparent plate 5. The formed location, the shape, the size, the roughness and the like of the irregular section 7a can be selected in the same manner as in the ninth embodiment of the present invention.

Figure 26:
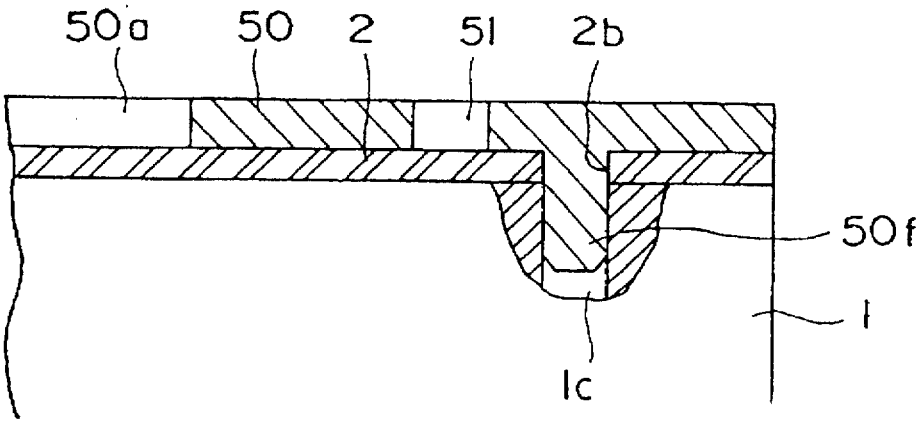
FIG. 26 is an outline of a sectional view of a fifteenth embodiment of the present invention, with the outer casing of the watch omitted.

FIG. 26 is an outline of a sectional view of a fifteenth embodiment of the present invention, with the outer casing of the watch omitted. In this embodiment, the metal plate 50 is used as the light transmitting type display plate. The ornamental sections such as dial, numbers, pattern, and the like, are formed by the hole 50a and the through-hole 51 provided in the metal plate 50, in the same manner as in the twelfth embodiment.

In addition, the projections 50f are provided on the lower surface of the metal plate 50 in the same manner as in the twelfth embodiment. The projections 50f pass through the through-holes 2b of the cell 2 and engage the installation holes 1c of the movement 1 so that the cell 2 and the metal plate 50 are firmly fixed to the movement 1.

Figure 27:
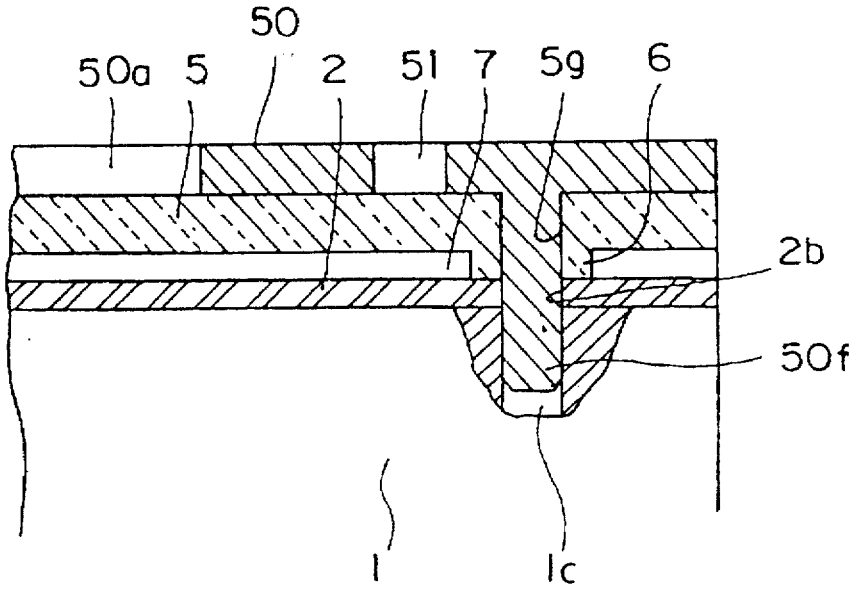
FIG. 27 is an outline of a sectional view of a sixteenth embodiment of the present invention, with the outer casing of the watch omitted.
Figure 28:
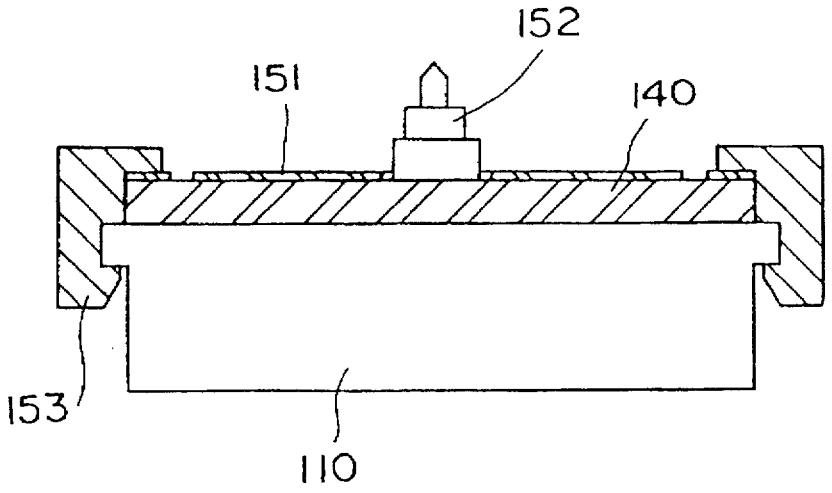
Figure. 28 Prior Art
FIG. 28 is an outline of a sectional view of a first conventional example, with the outer casing of the watch omitted.
Figure 29:
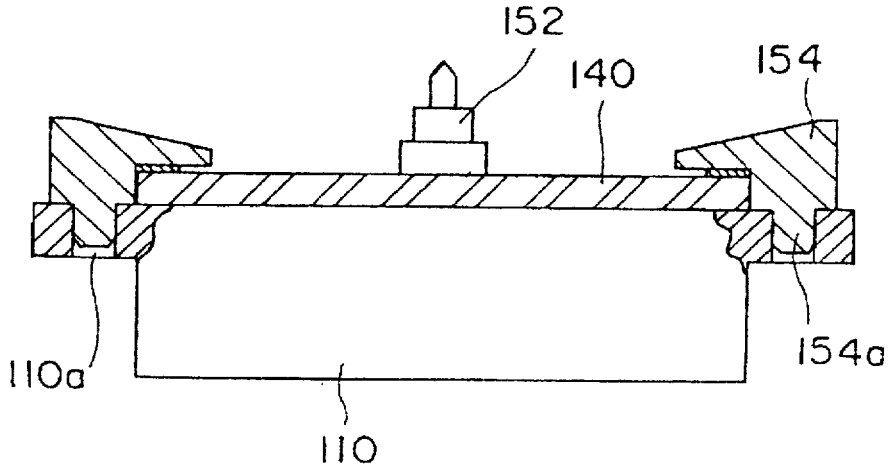
Figure. 29 (a) Prior Art
FIG. 29(*a*) is an outline of a sectional view of a second conventional example.
Figure 29:
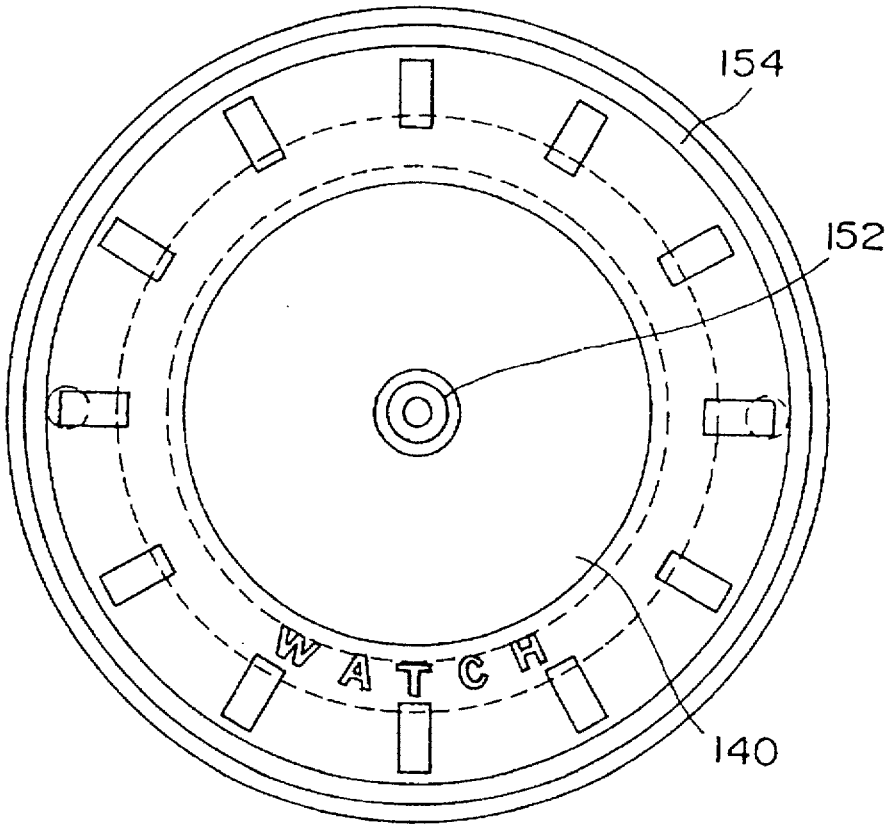
Figure. 29 (b) Prior Art
Figure 30:
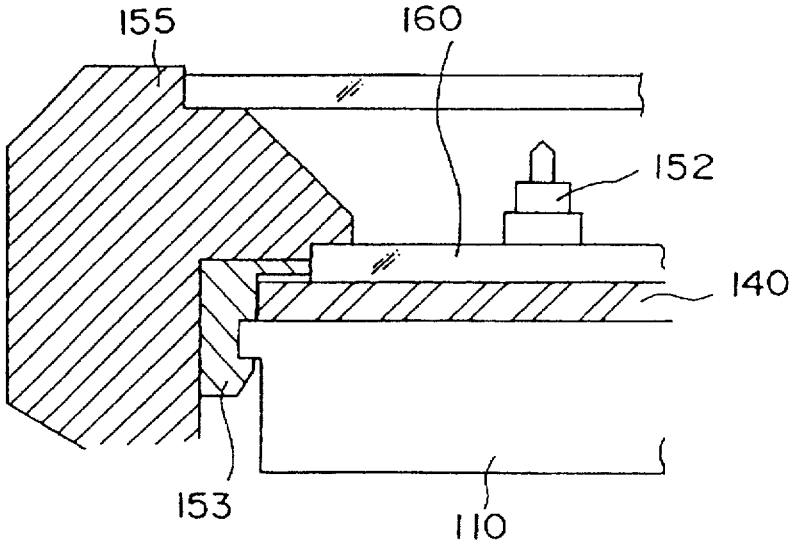
Figure. 30 Prior Art
FIG. 30 is an outline of a sectional view of the principal parts of the third conventional example.
Figure 31:
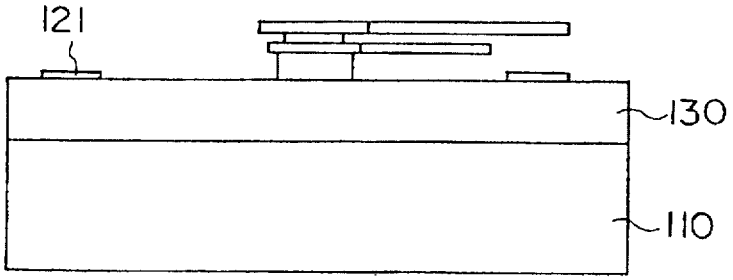
Figure. 31 Prior Art
FIG. 31 is an outline of a sectional view of a fourth conventional example, with the outer casing of the watch omitted.
Figure 32:
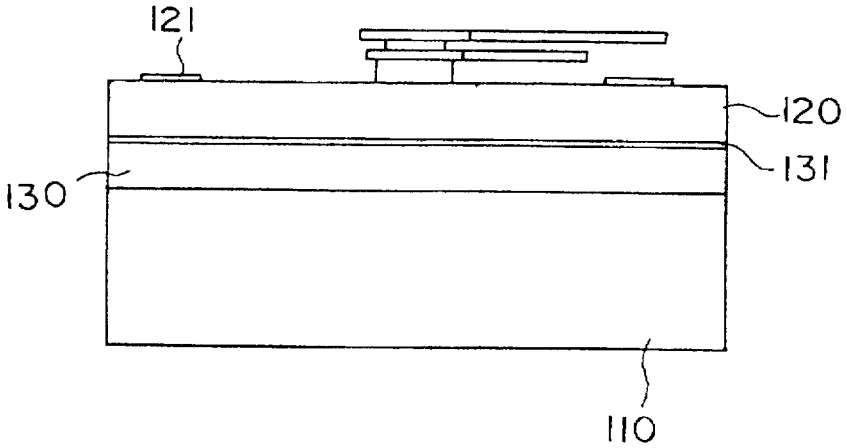
Figure. 32 Prior Art
FIG. 32 is an outline of a sectional view of a fifth conventional example, with the outer casing of the watch omitted.

FIG. 27 is an outline of a sectional view of a sixteenth embodiment of the present invention, with the outer casing of the watch omitted. In this embodiment, the metal plate 50 is laminated onto the upper surface of the transparent plate 5 as the light transmitting type display plate. The movement 1, the cell 2, and the metal plate 50 have the same configuration as in the fifteenth embodiment.

A through-hole 5g is provided on a transparent plate 5 in a position corresponding to the projection 50f of the metal plate 50. The projection 50f of the metal plate 50 passes through the through-hole 5g of the transparent plate 5 and the through-hole 2b of the cell 2 and engages the installation hole 1c of the movement 1. As a result, the cell 2, the transparent plate 5, and the metal plate 50 are firmly fixed to the movement 1.

In this case, the spacer 6 is integrally provided at the periphery of the through-hole 5g on the lower surface of the transparent plate 5. As a result, the gap 7 is formed at the cell 2, preventing the formation of Newton rings and the like.

The spacer 6 in this case may also be provided independently of the transparent plate in the same manner as in the thirteenth embodiment. It is also acceptable for the gap 7 between the cell 2 and the transparent plate 5 to be provided as an irregularity on the cell 2 and/or the transparent plate 5 in the same manner as in the fourteenth embodiment.

It is also possible to form the transparent plate 5 by laminating it onto the upper surface of the metal plate 50 as the light transmitting type display plate, although this is not shown in the drawings. In this case, a projection is provided on the lower surface of the transparent plate 5 and a through-hole is provided in the metal plate 50, so that the cell 2, the metal plate 50, and the transparent plate 5 are firmly fixed to the movement in the same manner as in the sixteenth embodiment.

The formation of the projection and the installation hole can also be the reverse of the case described for the above-mentioned embodiment. Specifically, the projection may be formed on the upper surface of the movement 1, and the installation hole may be provided in a corresponding position in the light transmitting type display plate which is the transparent plate or the metal plate.

INDUSTRIAL APPLICABILITY

As outlined above, it is possible to effectively utilize various types of watches provided with a light-absorbing member such as a solar cell or the like, and a light-emitting member made up of a light diffusion plate and an EL element, liquid crystals, or various types of light sources, as a watch with a light transmitting type display plate relating to the present invention.

We claim:

1. A watch comprising, a movement, a cell made of one of a light-emitting member and a light-absorbing member laminated onto the movement, a support member disposed above the cell for fixing the same, a light transmitting type display plate formed of one of a transparent plate and a semitransparent plate add arranged above the cell, means for forming a gap disposed between the display plate and the cell, said gap forming means preventing formation of light interference fringes over the cell, and positioning means having a first positioning section formed on the support member and a second positioning section formed on an outer periphery of the light transmitting type display plate, said first and second positioning sections being engaged together so that the display plate and the cell are fixed relative to the support member, and an additional gap is formed between the outer periphery of the display plate except the second positioning section and an inner periphery of the support member except the first positioning section.

2. The watch as claimed in claim 1, wherein the light-emitting member is an EL element and the light-absorbing member is a solar cell.

3. The watch as claimed in claim 1, wherein said first positioning section is a plurality of recesses formed in the support member, and said second positioning section is a plurality of lateral projections projecting laterally from the display plate so that when the watch is assembled, the display plate is disposed inside the support member and the lateral projections engage the recesses.

4. The watch as claimed in claim 1, wherein the second positioning section of the light transmitting type display plate is a projecting section extending from the outer periphery of the light transmitting type plate; and the first positioning section of the support member is an indented section formed in the support member.

5. The watch as claimed in claim 4, wherein the second positioning section of the light transmitting type display plate is provided with a notched section at almost a center of the projecting section; and the indented section of the support member is provided with a projection at a position corresponding to the notched section.

6. The watch as claimed in claim 4, wherein the second positioning section of the light transmitting type display plate and the first positioning section of the support member are respectively formed in multiple; at least one of the second positioning sections of the light transmitting type display plate has a notched section at almost a center of the second projecting section; and at least one of the indented sections of the support member has a projection at a position corresponding to the notched section of the at least one second projecting section.

7. The watch as claimed in claim 1 wherein the light transmitting type display plate includes ornamental sections having a dial, numbers, and patterns.

8. The watch as claimed in claim 1, wherein the gap between the light transmitting type display plate and the cell is formed by providing an irregularity on a surface of the transparent plate or the semitransparent plate opposing the cell.

9. The watch as claimed in claim 1, wherein the gap between the light transmitting type display plate and the cell is formed by providing an irregularity on the surface of the cell opposing the transparent plate or the semitransparent plate.

10. The watch as claimed in claim 1, wherein the gap between the light transmitting type display plate and the cell is formed to provide a pear-skin-like structure on a surface of the display plate opposing the cell.

11. The watch as claimed in claim 1, wherein the gap between the light transmitting type display plate and the cell is formed to interpose a spacer over an entire or at one part of the outer periphery between the display plate and the cell.

12. The watch as claimed in claim 11, wherein the spacer is formed integrally with the display plate.

13. The watch as claimed in claim 11, wherein the cell is a solar cell, and the spacer is a sheet section for extracting energy from the solar cell.

14. A watch comprising, a movement, a cell made of one of a light-emitting member and a light-absorbing member laminated onto the movement, a light transmitting type display plate formed of one of a transparent plate and a semitransparent plate and arranged over the cell, means for forming a gap disposed between the display plate and the cell, said gap forming means preventing formation of light interference fringes over the cell, and a positioning section formed under a surface of the light transmitting type display plate to project therefrom, and a positioning hold formed in the movement, said positioning section passing through the cell and engaging the positioning hole so that the display plate and the cell are fixed to the movement.

15. The watch as claimed in claim 14, wherein the light-emitting member is an EL element and the light-absorbing member is a solar cell.

16. The watch as claimed in claim 14, wherein the gap between the light transmitting type display plate and the cell is formed by providing an irregularity on the surface of the transparent plate or the semitransparent plate opposing the cell.

17. The watch as claimed in claim 14, wherein the gap between the light transmitting type display plate and the cell is formed by providing a pear-skin-like structure on a surface of the transparent plate or the semitransparent plate opposing the cell.

18. The watch as claimed in claim 14, wherein the gap between the light transmitting type display plate and the cell is formed by interposing a spacer over an entire or at one part of an outer peripheral section between the display plate and the cell.

19. The watch as claimed in claim 18, wherein the spacer is formed integrally with a root of a projection of the positioning section, said spacer forming said means for forming the gap.

20. The watch as claimed in claim 14, wherein the light transmitting type display plate includes ornamental sections having a dial, numbers and patterns.

21. The watch as claimed in claim 14, wherein the gap between the light transmitting type display plate and the cell is formed by providing an irregularity on the surface of the cell opposing the transparent plate or the semitransparent plate.

* * * * *